US005622727A

United States Patent [19]

Cuman et al.

[11] Patent Number: 5,622,727

[45] Date of Patent: Apr. 22, 1997

[54] AUTOMATIC PRESSURE-CASTING BENCH

[75] Inventors: Giorgio Cuman, Cordenons; Delfino Rovere, Cusano Di Zoppola; Toffolo R. Petrucco, Roveredo In Piano, all of Italy

[73] Assignee: American Standard Inc., Piscataway, N.J.

[21] Appl. No.: 459,583

[22] Filed: Jun. 2, 1995

[30] Foreign Application Priority Data

Jun. 2, 1994 [IT] Italy ..... RE94A0041

[51] Int. Cl.[6] ..... B28B 1/26

[52] U.S. Cl. ..... 425/84; 425/338; 425/441; 425/451.9; 425/468

[58] Field of Search ..... 425/84, 85, 195, 425/234, 338, 441, 450.1, 451.9, 468

[56] References Cited

U.S. PATENT DOCUMENTS 3,691,266 9/1972 Greenberg ..... 425/451.9

4,913,640 4/1990 Spieler et al. ..... 425/195

5,120,211 6/1992 Ito et al. ..... 425/84

*Primary Examiner*—James P. Mackey

*Attorney, Agent, or Firm*—Ann M. Knab; Elaine Brenner Robinson

[57] ABSTRACT

Pressure-casting bench for vitreous china sanitary fixtures having two guides on which mold parts travel in a horizontal direction, capable of pairing so as to bound a molding cavity, a set of guides or rails being provided for introducing into and removing from the cavities so bounded, additional mold parts known as mandrels. An upper support structure is provided capable of supporting a horizontal beam and causing it to travel in a plane at right angles to the plane defined by the guides under which all the mandrels are fixed in order to enter the molding cavities. A series of plates, spindles and springs are provided for the mandrels as well as a series of pegs for clamping the mandrels to the mold parts thereunder and encasing the molding cavities and subsequently releasing the mandrels from the mold parts.

7 Claims, 10 Drawing Sheets

AUTOMATIC PRESSURE-CASTING BENCH

BACKGROUND OF THE INVENTION

The present invention relates generally to a casting bench for the molding of vitreous china sanitary fixtures, having complicated shapes, such as toilet bowls, water closets, and bidets.

These fixtures are formed in hygroscopic molds, generally fabricated of plaster or a suitable resin, composed of several complementary parts. The molds typically comprise at least three parts, two of them paired to form a cavity and at least one capable of entering the cavity to create the space in which the fixture is formed.

The molds are used in sets, in which case each of the two paired parts forming the mold has two half-cavities on its opposed faces, so as to create, with two identical parts placed on their sides, two complete forming cavities. Into these complete forming cavities, the third part of the mold, also known as the tool or mandrel, is inserted from above, and possibly a fourth part, known as the foot, is inserted from below.

The most troublesome operation to be performed in the process of casting is the step of de-molding which entails detaching the mold from the casting. This step must be performed with great care so as not to damage the casting, which is still soft and quite fragile. The operation of de-molding has been heretofore performed manually, with a great expenditure of labor.

Thus, it is apparent that an improved method of de-molding is desired which reduces time and labor and it is important that the method be automated.

SUMMARY OF THE INVENTION

An object of the invention is to automate the casting operation used in making sanitary ware.

Another object is to automate the step of de-molding cast ware from the casting press.

These and other objects and advantages are achieved by the present invention which provides a casting press having a casting bench with a set of guides carrying carriages which contain mold parts. The mold parts are capable of being paired so as to form and bound a molding cavity. Additional mold parts known as mandrels are supported and guided on a set of rails or guides. The mandrels are capable of being inserted into and removed from the bound cavities. When the casting is ready for removal from the mold parts, an actuating means having a series of movable pegs is provided to engage the carriages containing the mold parts and detach the mold parts from the molded casting which remains attached to the bottom mandrel.

A pair of symmetrical shells which perfectly match the shape of the casting are provided to detach the casting from the mandrel. The shells are coupled to a carriage system which is actuated by a motor in combination with a pneumatic cylinder and piston means.

BRIEF DESCRIPTION OF THE DRAWINGS

The invention will be more fully appreciated from the following detailed description when the same is considered in connection with the accompanying drawings in which.

DETAILED DESCRIPTION OF THE INVENTION

Figure 1:
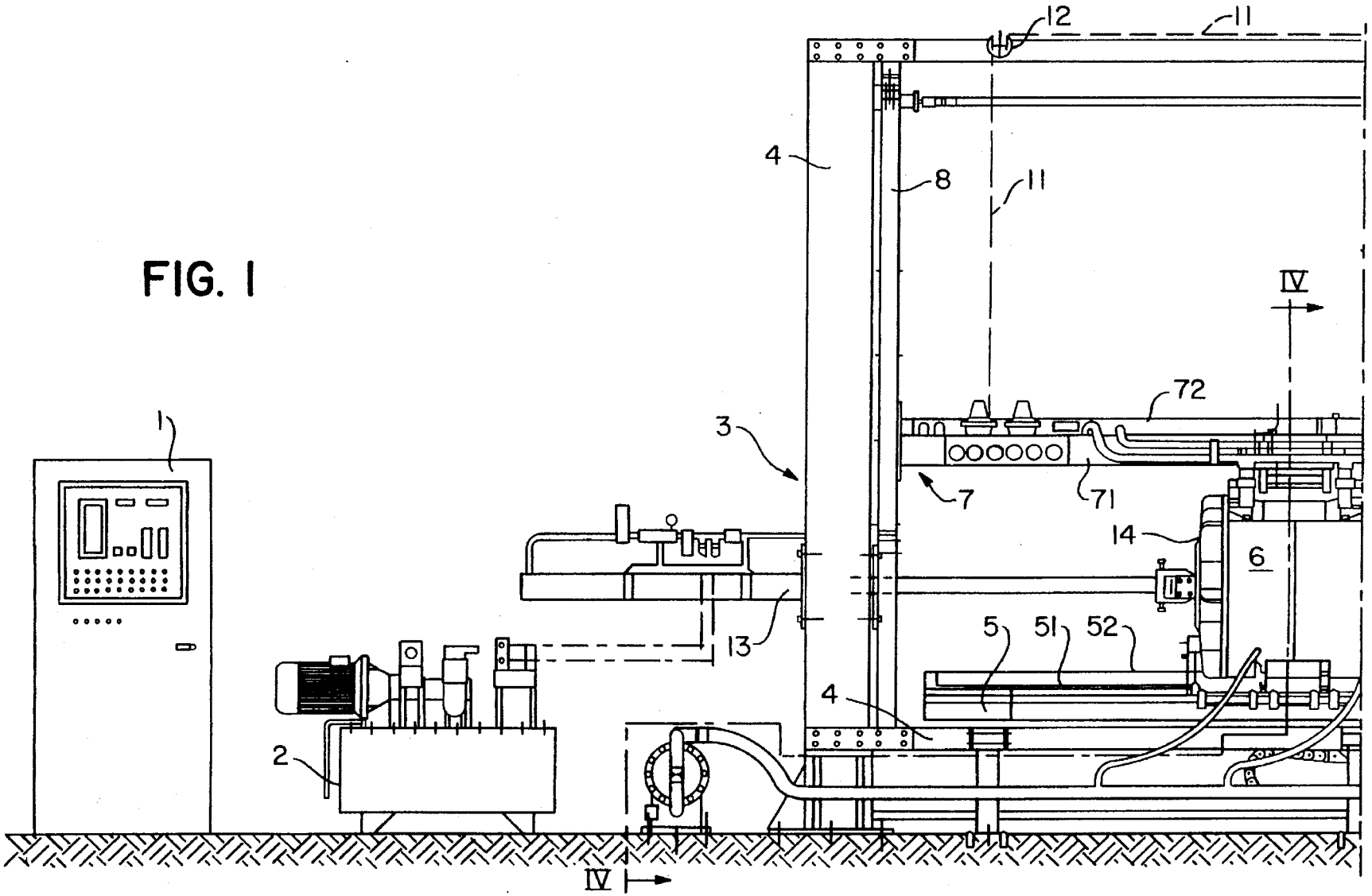
FIG. 1 is a partial view showing a first portion of the casting bench in accordance with the present invention.

Reference is now made to the figures which show a control cabinet 1 controlling a hydraulic oil power station 2 located at the forward end of a casting line 3. Casting line 3 comprises a fixed framework 4 supporting an inclined bench 5. On bench 5 are disposed casting molds 6, each composed of a top mandrel 61, a bottom foot 62 and two symmetrical parts 63 and 64. Top mandrels 61 are suspended from a single common beam 7 capable of traveling parallel to itself on inclined guides 8 which are disposed at right angles to the plane of the bench 5. The guides 8 are fixed, in a manner not shown, to the flamework 4, and the movement of beam 7 is controlled by an electric motor 9, connected to a gear box, supported at the center of framework 4 at the top thereof, and connected to beam 7 by known means. Beam 7 is counterweighted with weights 10, placed at one end of the bench and connected to the beam by cables 11 running on sheaves 12.

Figure 2:
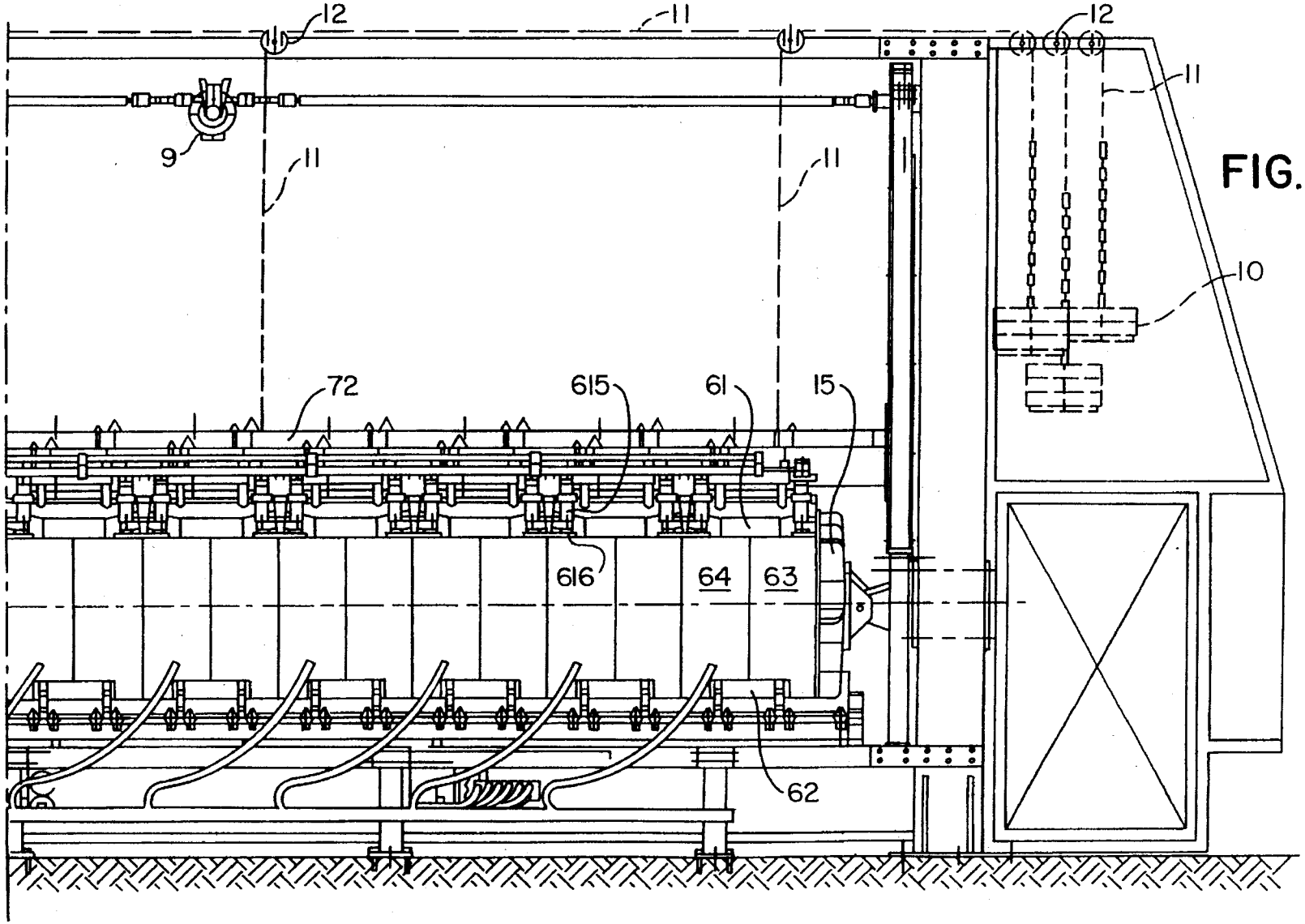
FIG. 2 is a partial view showing a second portion of the casting bench which completes the first portion of the casting bench shown in FIG. 1.
Figure 3:
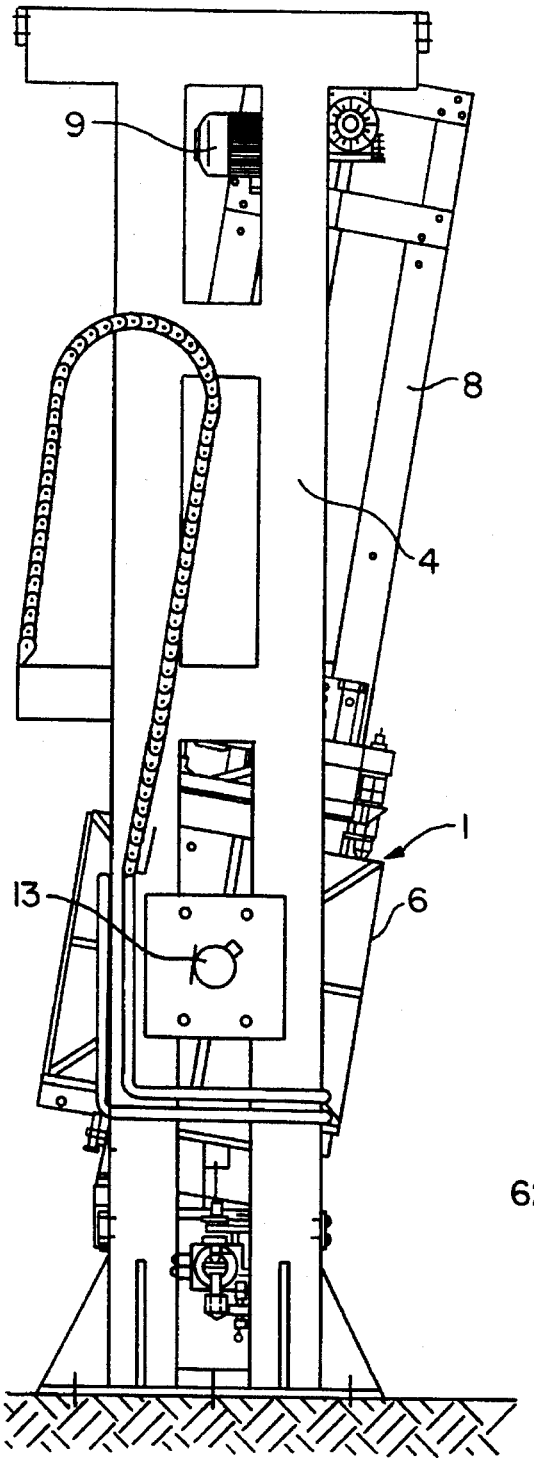
FIG. 3 is a side view of the casting bench shown in FIG. 1.
Figure 4:
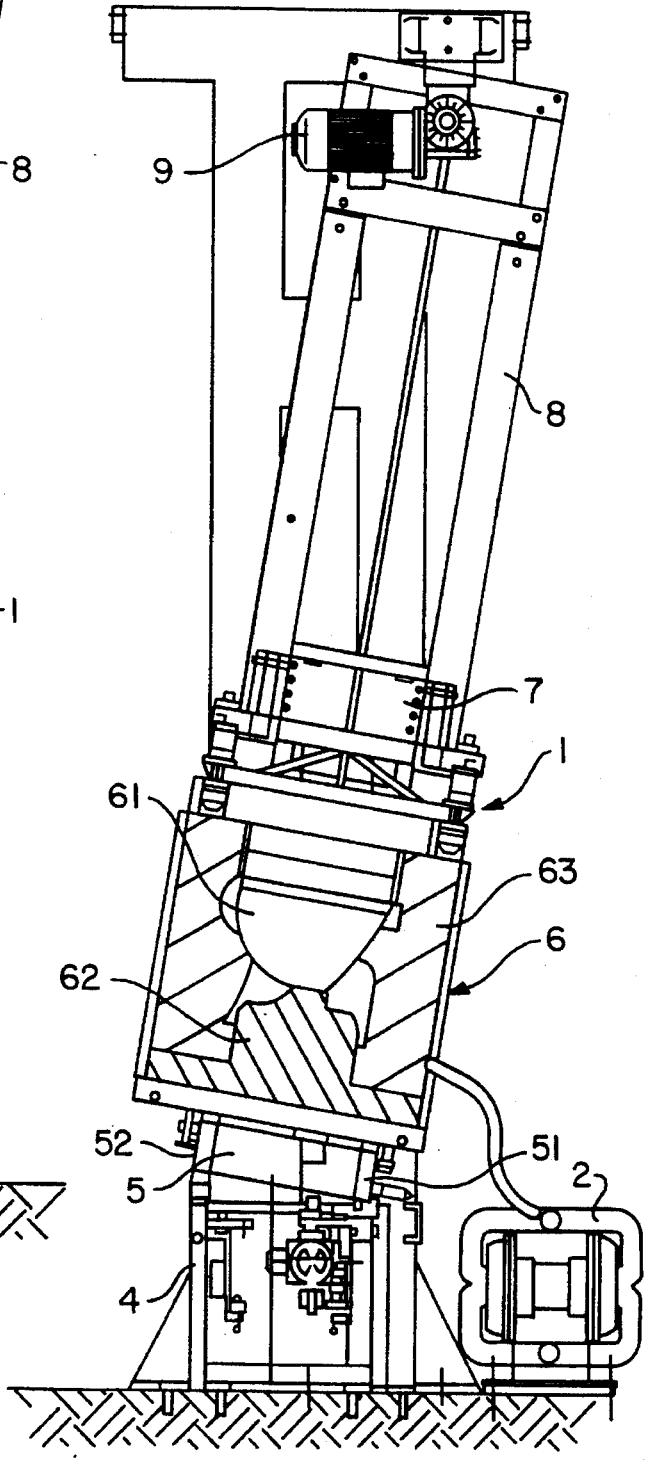
FIG. 4 is a sectional view of the casting bench shown in FIG. 1 along line IV—IV.

As shown in FIG. 1, at the left end of casting bench 5 the body of a piston and cylinder means 13 is fixed, wherein a piston rod engages the center of a thrust member 14 which is capable of traveling on inclined bench 5. As shown in FIG. 2, at the opposed end of casting bench 5, a counterthrust member 15 is fixed to framework 4, equal to and symmetrical with member 14.

Figure 11:
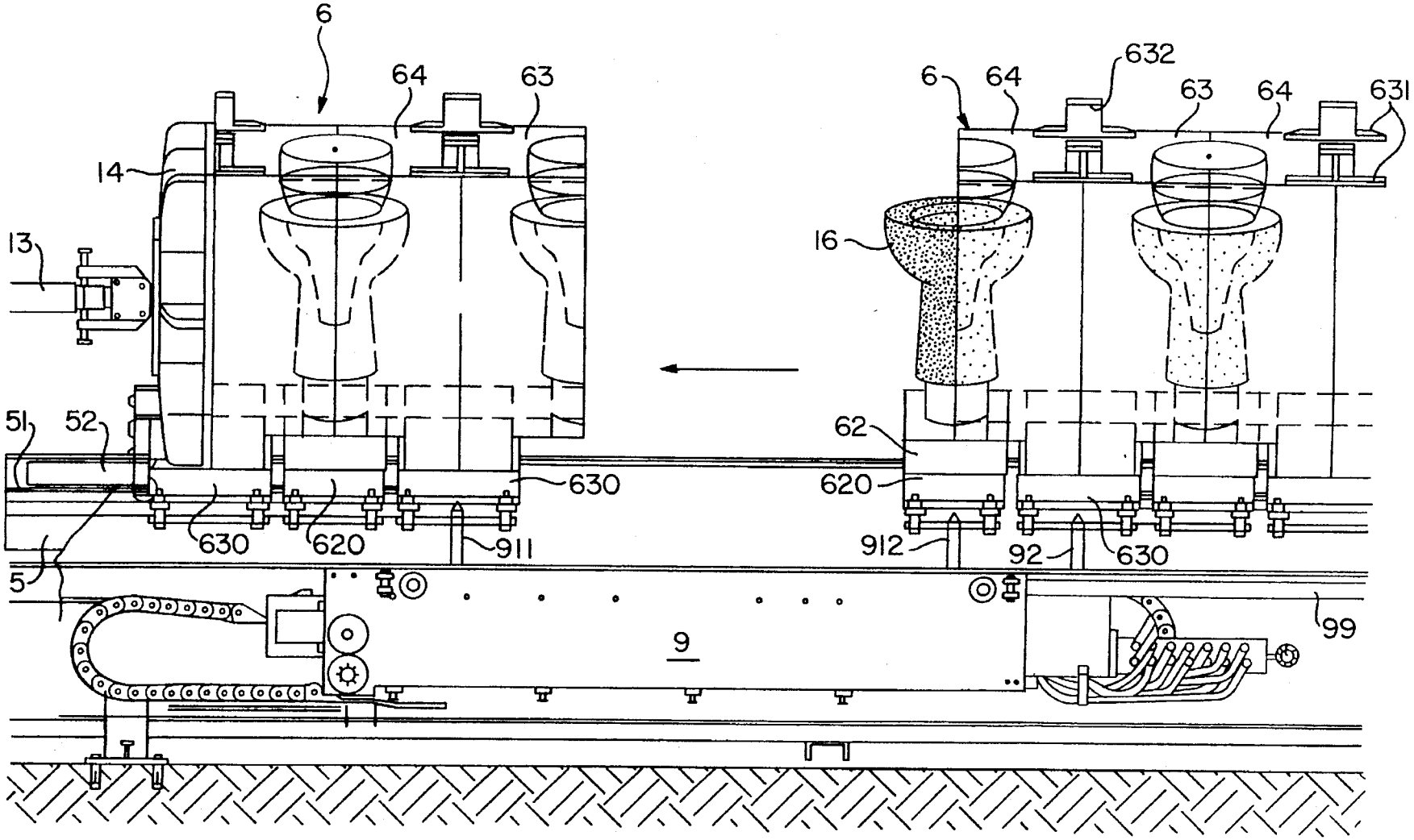
FIG. 11 is an exploded view of the lower part of the casting bench during unmolding.

Inclined bench 5, as shown in FIG. 11, is composed of two parallel guides 51 and 52 on which travel, for each mold 6, a carriage 630 bearing two lateral half molds 63 and 64, joined back-to-back, and a carriage 620 bearing foot 62. Top mandrels 61 are fixed to upper beam 7, with freedom of movement in the vertical direction, for raising and lowering, but not in the horizontal direction along the casting line.

Reference is now made to FIGS. 5 through 10, which depict beam 7 and a pair of parallel stringers or horizontal support members 71 and 72 to which are fixed beneath, by way of stirrups or supports 610, a series of frames 611 and mandrels 61 with the number of frames and mandrels being equal. At the corners of each frame 611 are fixed four spindles or axles 612. On each pair of spindles 612 is freely threaded a plate 613 and springs 614 are interposed on spindles 612. At the ends of each plate 613 is fixed a pneumatic cylinder 615 whose shaft is turned downward and which bears a hammer head shaped piece 616.

A mandrel 61 is fixed to a pair of plates 613 by means of a superstructure or upper support means 617. The lateral half-molds 63 and 64 are stably fixed, two-by-two and back-to-back, to form a single block, excepting, of course, the two end half-molds. Each block formed by two half-molds fixed stably back-to-back comprises, straddling their line of junction, two stirrups or supports 631, each of which bears a bracket 632 at its upper end.

Figure 5:
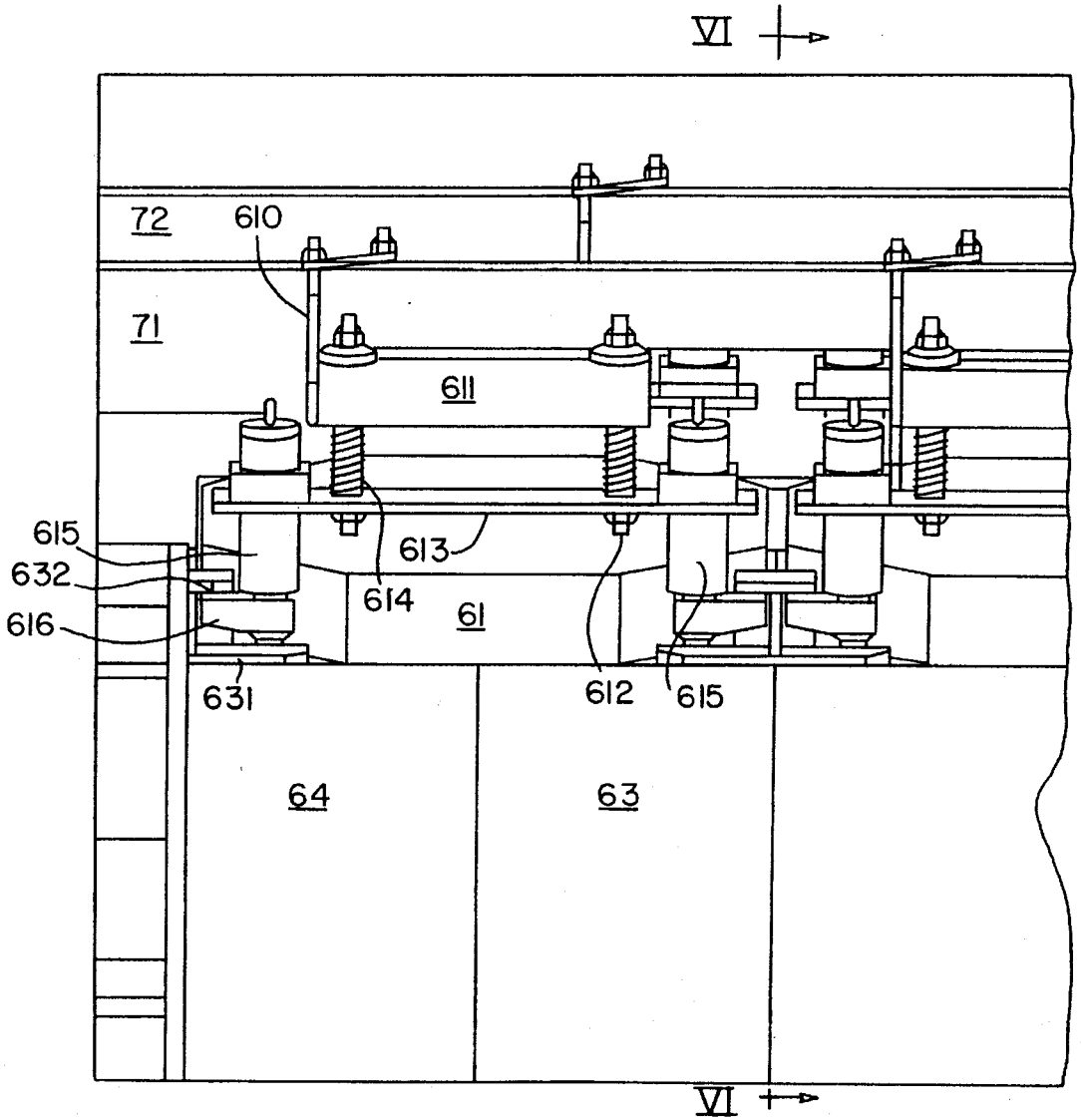
FIG. 5 is a partial view of the upper part of a closed mold on the casting bench as viewed from the front side.
Figure 6:
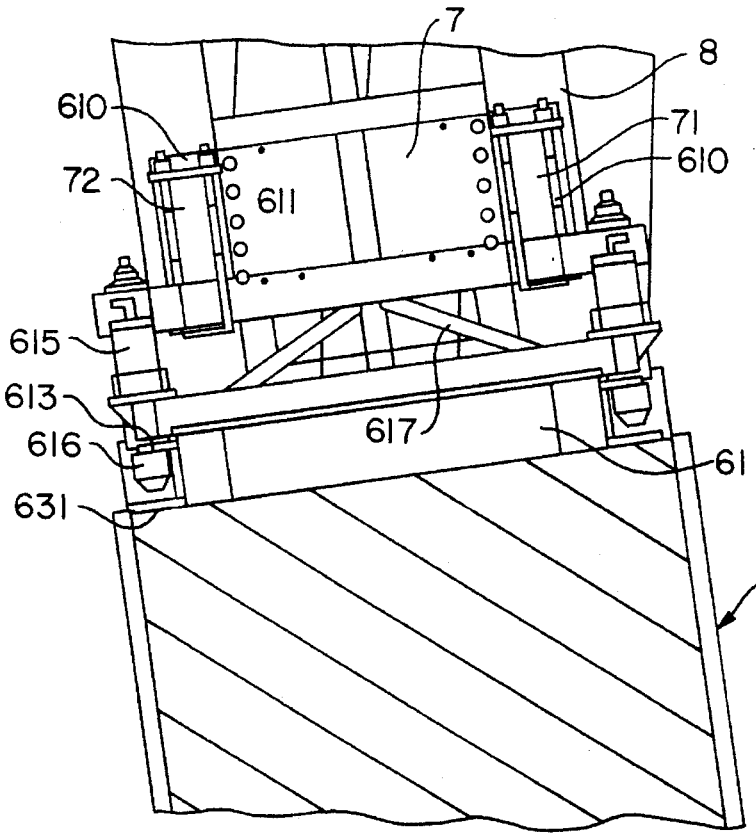
FIG. 6 is a sectional view of the closed mold shown in FIG. 5 along line VI—VI.
Figure 8:
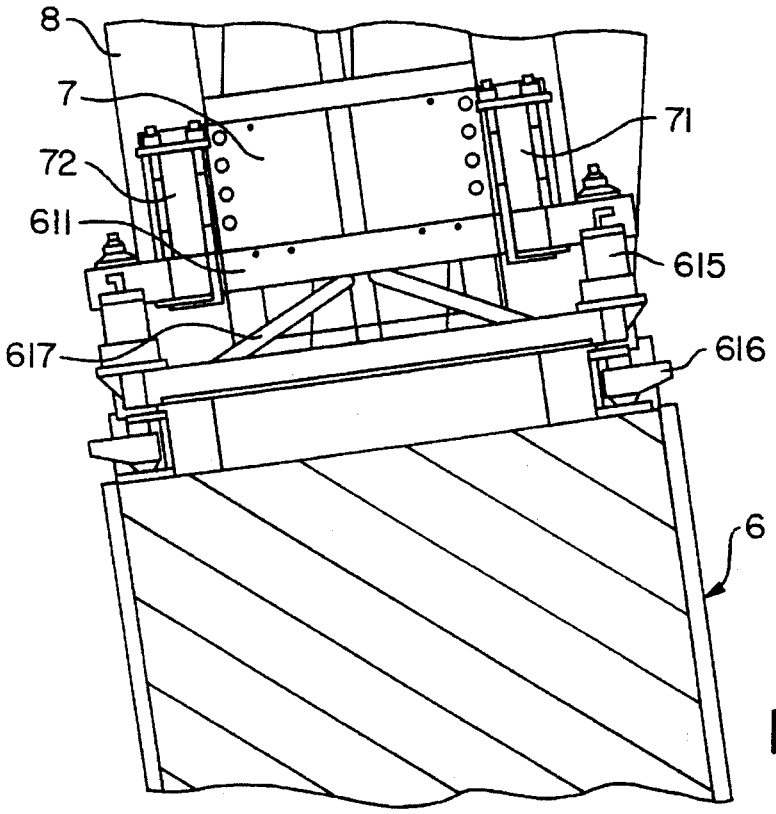
FIG. 8 is a sectional view of the mold in FIG. 7 along line VIII—VIII.
Figure 7:
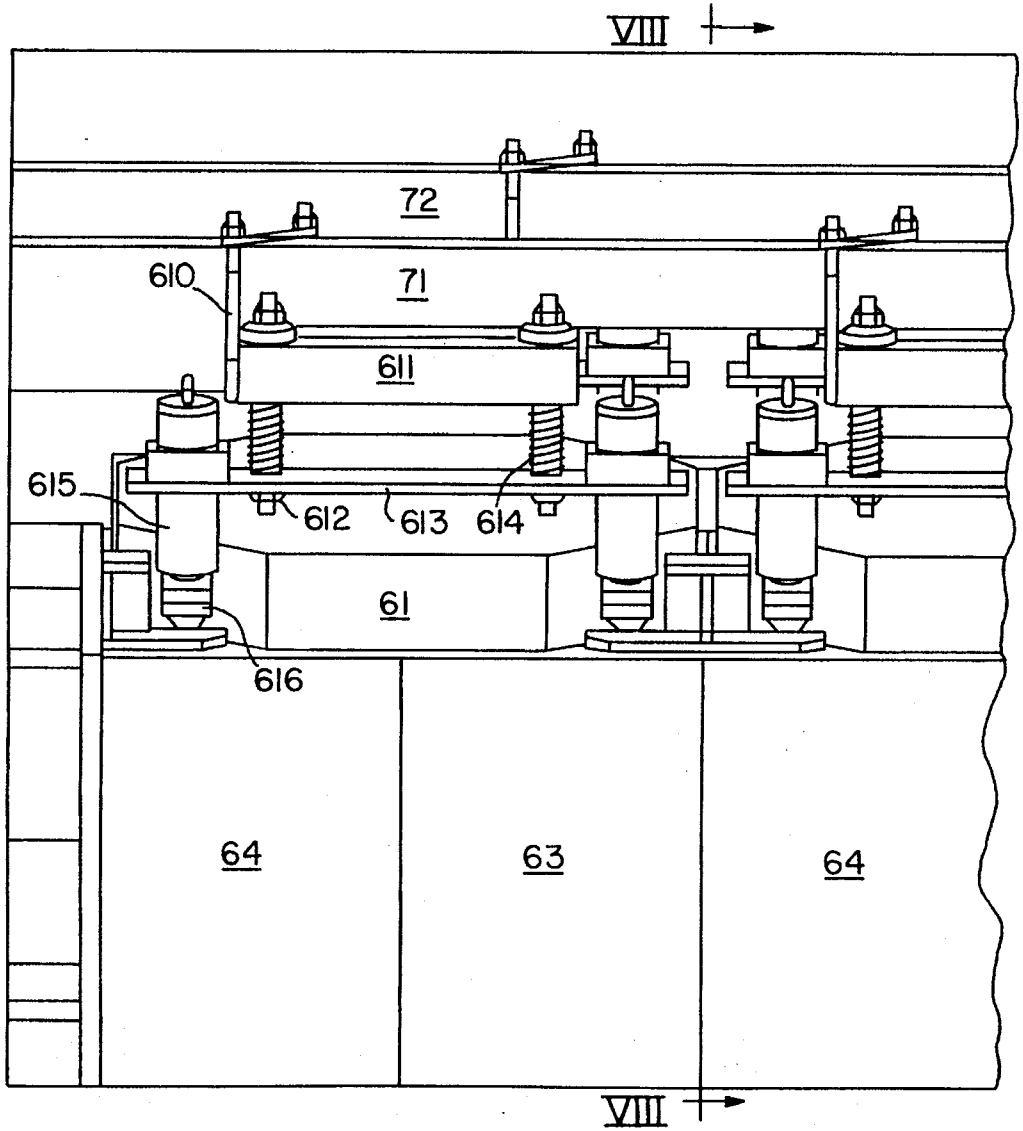
FIG. 7 is a partial view of the mold in FIG. 5 after disengagement of the top mandrel.

Below brackets 632 are arranged hammer heads 616 which may be rotated 90 degrees. When beam 7 is lowered, mandrel 61 is inserted into the cavity formed between two half-molds 63 and 64. Mandrel 61 is thrust downward by the aid of springs 614, and is mechanically locked into position by hammer heads 616 which are actuated by cylinders 615. Cylinders 615 draw hammer heads upward, simultaneously rotating them 90 degrees by virtue of helicoidal guides not shown, until they contact brackets 632. This connection ensures that the mold faces match each other as shown in FIGS. 5 and 6. Upon opening of the molds, cylinders 615 are actuated in the opposite direction until hammer heads 616 come to rest, as shown in FIGS. 7 and 8, on stirrups 631 below, and gently push mandrels 61 apart from the casting.

Figure 9:
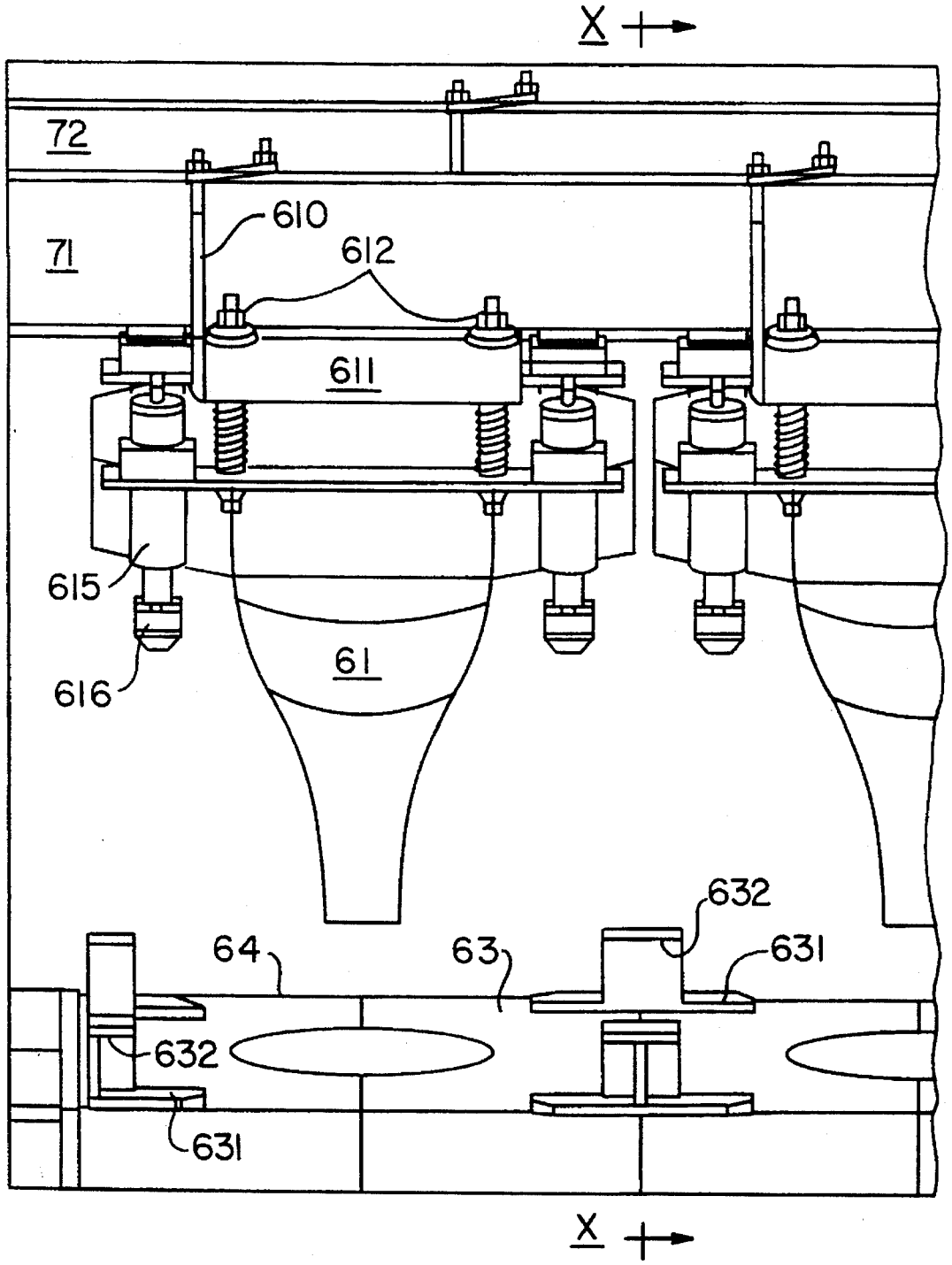
FIG. 9 is a partial view of the mold shown in FIG. 5 with the top mandrel raised.
Figure 10:
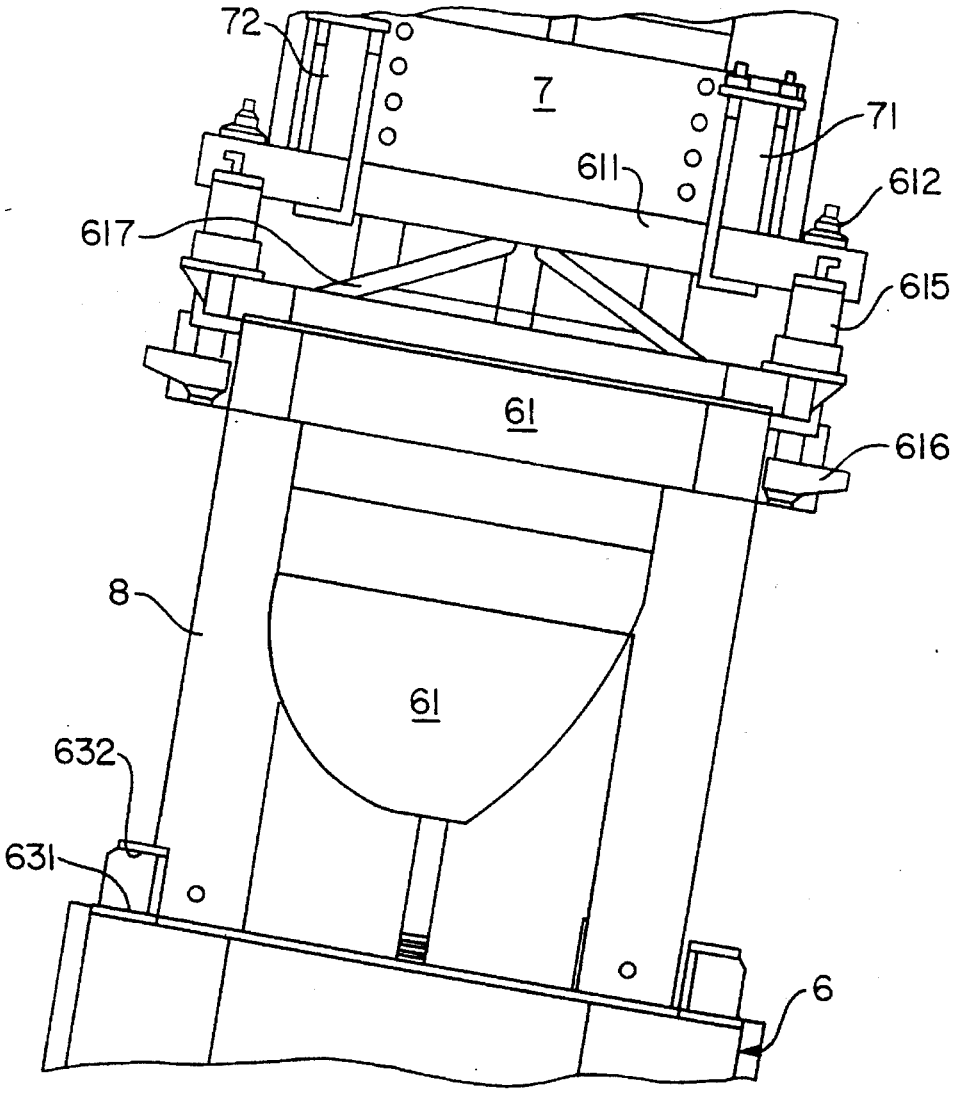
FIG. 10 is a sectional view of the mold shown in FIG. 9 along line X—X.

Upon detachment, beam 7 is raised as shown in FIGS. 9 and 10, effecting the complete withdrawal of mandrel 61 from the cavity formed by the two half-molds 63 and 64. FIG. 11 shows lower guides 51 and 52, upon which carriages 630, 620, and 630, respectively, travel. Between and below guides 51 and 52 is an actuating means 90 which travels lengthwise, capable of placing itself in turn under each of the molds to be opened, and traveling on rails 99. Means 90 includes two vertical pegs 911 and 912, located on the upper surface thereof and movable both longitudinally and vertically along the center line of means 90. Means 90 also includes peg 92 movable vertically only, relative to means 90.

The mechanisms permitting the vertical and horizontal movements of pegs 911, 912 and 92 are not shown, for the sake of clarity, and are of simple and obvious construction. The opening of the molds arranged on the bench is begun after top mandrels 61 have been withdrawn completely. Actuating means 90 is shifted to a position proximate with pegs 911, 912 and 92 under the first mold to be opened, in which position the pegs are at the left end of means 90 as shown in FIG. 11.

Thrust member 14 is withdrawn by action of the cylinder and piston means 13 which allows for the opening of all of the molds. Pegs 911, 912 and 92 are raised and engage carriage 630, carriage 620 and carriage 630, respectively, which contain half-molds 63 and 64 which form the cavities to be opened, and foot 62 which is placed in the cavity. Peg 911 engaging carriage 630 and peg 912 engaging carriage 620 are moved to the left in FIG. 11. Carriage 620 is moved to the rear of and between the two half-molds 63 and 64, and casting 16 is then removed, the details of which will be discussed later. Once the casting 16 has been removed, pegs 911, 912 and 92 are lowered and actuating means 9 shifts to the right in FIG. 11 until peg 911 is positioned in the position previously occupied by peg 92. Pegs 911, 912 and 92 are raised and the cycle repeats itself.

Figure 14:
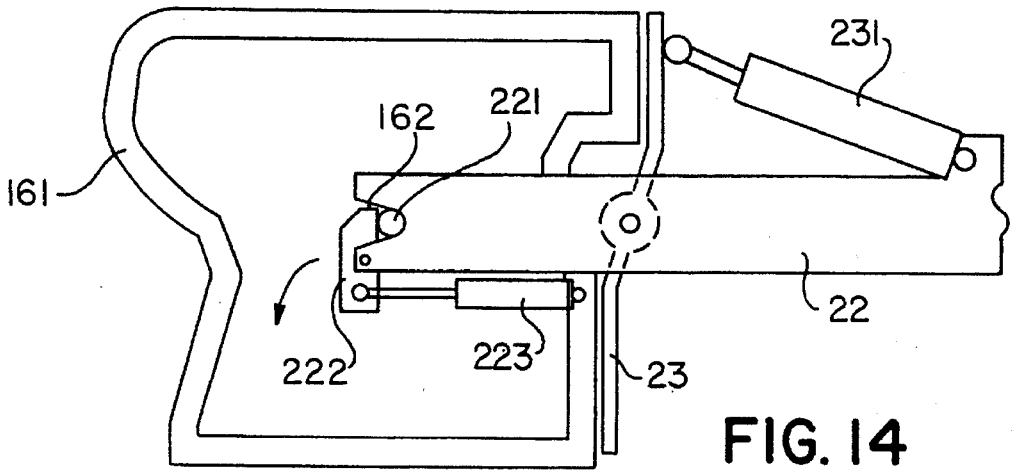
FIG. 14 is a partial exploded view showing the means for removal.
Figure 13:
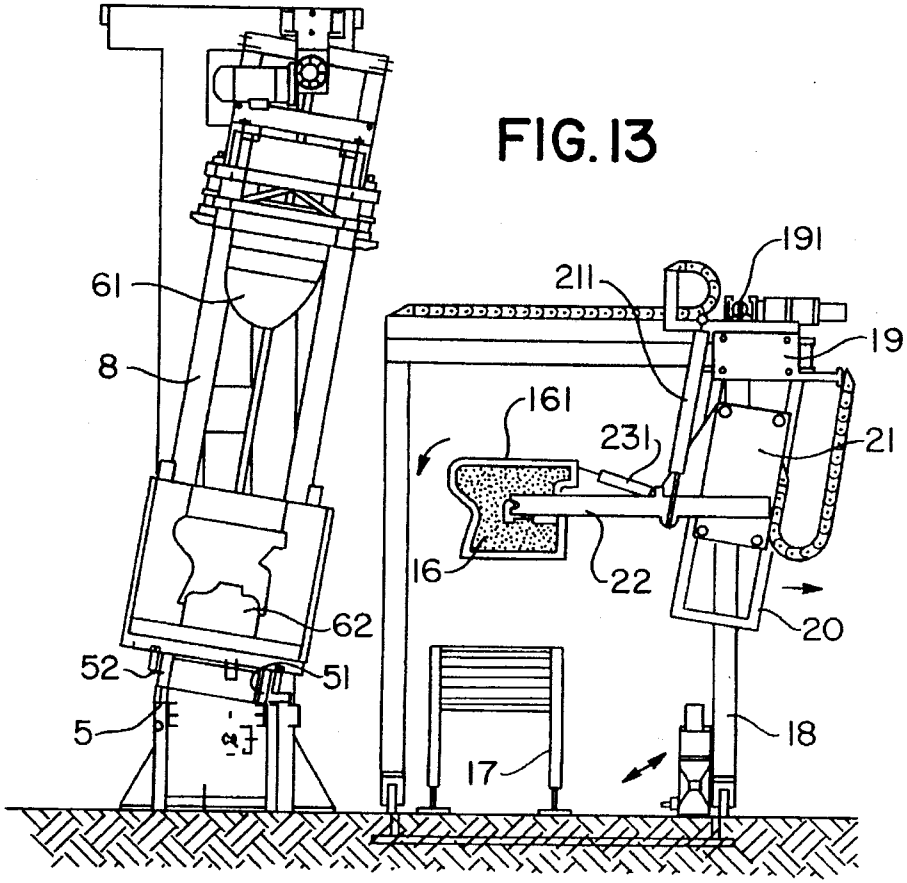
FIG. 13 is a sectional view of the casting bench including a means for removal disposed in a second operating position.
Figure 12:
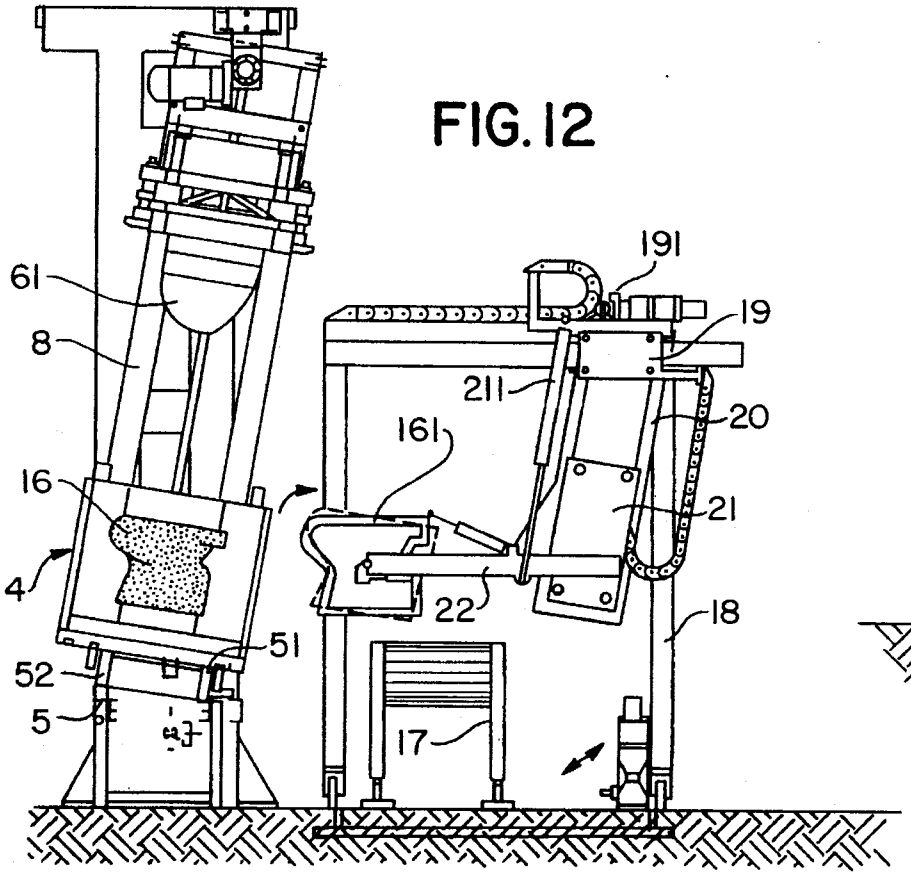
FIG. 12 is a sectional view of the casting bench including a means for removal of the casting disposed in a first operating position.

When all castings 16 have been removed, thrust member 14 is advanced by the action of cylinder and piston means 13, and the set of molds is repositioned as shown in FIG. 1. Beam 7 is lowered, repositioning mandrels 61 as shown, and, with the molds completely closed, a second casting slip is poured and the cycle repeats itself. As shown in FIGS. 12, 13 and 14, horizontal conveyor 17 is located in front of the casting press for receiving castings 16 which have been de-molded. Bridge structure 18 which straddles conveyor 17 travels parallel to the center line of the casting bench. Located atop structure 18 is carriage 19 which travels horizontally in the direction at right angles to the center line of the casting bench. From carriage 19, two inclined guides 20 descend at right angles to the plane determined by guides 51 and 52 of the casting bench. On guides 20 travels a second carriage 21 from which extend two cantilevered brackets 22. An electric motor 191, connected to a gear box, actuates carriage 19. The movements of carriage 21 are driven by a pneumatic cylinder and piston means 211. At the end of brackets 22 is located seat 221 closed by lever 222 at its forward end. Lever 222 is actuated by a cylinder and piston means 223. In rearward position between brackets 22 is placed an oscillating wall 23 linked to the brackets by a cylinder and piston means 231.

Removal of casting 16 takes place as follows. At the sides of casting 16 are placed two symmetrical shells 161 perfectly matching its shape. Each shell 161 has a pin 162. The brackets 22 are advanced until pins 162 drop into seats 221 and are locked in by levers 222. The brackets are then raised to detach the casting from the bottom mandrel or foot 62. The casting is raised by oscillating wall 23 under the actuation of the cylinder and piston means 231, and deposited on conveyor 17.

Although illustrative embodiments of the present invention have been described herein with reference to the accompanying drawings, it is to be understood that the invention is not limited to those precise embodiments and that various other changes and modifications may be effected therein by one skilled in the art without departing from the scope or spirit of the invention.

What is claimed is:

1. An apparatus for forming vitreous china sanitary ware castings comprising:

a fixed frame;

a casting bench fixed to said frame, said casting bench including a first set of parallel guides disposed horizontally;

a plurality of movable mold parts located on said first set of guides, said mold parts capable of being paired in sets to form and bound a plurality of cavities, respectively;

a second set of guides fixed to said frame and disposed at right angles to a plane of said bench;

a movable beam disposed on said second set of guides, positioned horizontally parallel to said bench;

an upper support means fixed to said beam for supporting a plurality of mandrels;

said plurality of mandrels fixed to said upper support means which is fixed to said beam, said mandrels capable of being inserted into and removed from said cavities formed by said mold parts;

a plurality of lower frames which equal in number said plurality of mandrels, each lower frame including an elastic suspension means for said mandrels, said suspension means coupled to said beam, said suspension means including a pair of plates, each plate freely threaded on a pair of spindles, a series of springs interposed on each spindle and each spindle being supported between said plates by said upper support means; and a means for locking said mandrels to said mold parts and for releasing said mandrels from said cavities.

2. The apparatus according to claim 1 wherein each plate includes a pair of cylinders at each end, each cylinder having a shaft disposed downward and provided with a hammer head, a third set of guides coupled to said cylinders for rotating said cylinders.

3. The apparatus according to claim 2 wherein said locking means includes a pair of stirrups comprising a bracket under which is engaged said hammer head to keep said mandrel locked against said cavity.

4. The apparatus according to claim 3 further including an actuating means coupled to a fourth set of guides positioned below said frame such that said actuating means is positioned beneath two said mold parts to be opened and includes a means capable of ascending so as to be locked under said mold parts to be opened and of moving horizontally to separate said mold parts, individually.

5. The apparatus according to claim 4, wherein said actuating means comprises a first peg in fixed position and at least a second peg capable of moving horizontally along a center line of said casting bench, both of said pegs being movable vertically to engage with and disengage from the respective mold parts.

6. The apparatus according to claim 5 further including a lateral conveyor straddled by a bridge structure, said bridge structure including a means for picking up said castings from said bench and placing said castings on said conveyor.

7. The apparatus according to claim 6 wherein said bridge structure includes a first carriage capable of traveling horizontally in a direction at right angles to a center line of said casting bench, a second carriage capable of traveling horizontally in a direction at right angles to said first set of guides, a pair of brackets extending from said second carriage, said brackets including a grasping means and a rearward supporting means for removing said castings.

* * * * *